United States Patent [19]

Yamane et al.

[11] Patent Number: 5,018,313

[45] Date of Patent: May 28, 1991

[54] ROUNDNESS PROCESSING DEVICE OF A SLIPPER SURFACE OF A ROCKER ARM

[75] Inventors: Shuji Yamane; Seiji Tou, both of Kyoto, Japan

[73] Assignee: Kabushiki Kaisha Nisshin Seisa Kusho, Kyoto, Japan

[21] Appl. No.: 406,353

[22] Filed: Sep. 12, 1989

Related U.S. Application Data

[63] Continuation-in-part of Ser. No. 156,000, Feb. 16, 1988, abandoned.

[30] Foreign Application Priority Data

Jul. 3, 1987 [JP] Japan ..... 62-167355

[51] Int. Cl.[5] ..... B24B 19/26

[52] U.S. Cl. ..... 51/165.71; 29/563; 51/165.76; 51/165.77; 51/215 UE; 51/217 A; 51/217 S

[58] Field of Search ..... 29/563; 51/96, 124 R, 51/124 L, 165.71, 165.76, 165.77, 215 CP, 215 E, 215 UE, 217 A, 217 S, 234

[56] References Cited

U.S. PATENT DOCUMENTS 2,289,693 7/1942 Blazek ..... 51/124 R 2,982,058 5/1961 Maitenaz ..... 51/124 R 4,545,106 10/1985 Juengel ..... 29/563

*Primary Examiner*—Frederick R. Schmidt

*Assistant Examiner*—Jack Lavinder

*Attorney, Agent, or Firm*—Mason, Fenwick & Lawrence

[57] ABSTRACT

A roundness processing device for a slipper surface of a rocker arm capable of rounding the slipper surface of the rocker arm without forming roundness on the polishing surface of a grinding wheel. A wheel side unit containing a disc-shaped grinding wheel, a jig side unit for holding and oscillating the rocker arm, a conveyor for conveying the rocker arm, and an access robot for moving in and out the rocker arm are automatically driven and controlled, as being mutually related, by automatic control such as numerical control. The polishing surface of the grinding wheel is formed on a plane vertical to the rotary shaft line of the grinding wheel, while the slipper surface of the rocker arm is oscillated about the oscillation shaft line positioned at a distance of a specific radius of curvature from the polishing surface. This oscillation shaft line is parallel to the polishing surface, and within a plane perpendicular to the polishing surface containing the contact line between the polishing surface and slipper surface.

22 Claims, 10 Drawing Sheets

ROUNDNESS PROCESSING DEVICE OF A SLIPPER SURFACE OF A ROCKER ARM

This application is a continuation-in-part of Ser. No. 07/156,000 filed on 2-16-88, which is now abandoned.

BACKGROUND OF THE INVENTION

1. Field of the Invention

This invention relates to a roundness processing device for a slipper surface of a rocker arm which operates the suction and exhaust valves of an automotive engine, and more particularly to a roundness processing device for a slipper surface of a rocker arm capable of rounding the slipper surface of the rocker arm without forming roundness on the polishing surface of a grinding wheel, and automatically driving and controlling the drive mechanisms in mutual relationship so as to enhance the working efficiency and lower the manufacturing cost.

2. Description of the Prior Art

The conventional process of polishing, in a round shape, the slipper surface of a rocker arm for operating the suction and exhaust valves of an automotive engine was as shown in FIG. 15; that is, a disc-shaped grinding wheel e of which the outer circumference (polishing surface) b is in the same shape as the round shape of a slipper surface d of a rocker arm c was mounted on a rotary shaft a of a plane grinding machine, while said rocker arm c was supported on a supporting shaft f which crossed orthogonally with said rotary shaft a, and said rocker arm c was reciprocated in the direction of the supporting shaft f while rotating and driving said grinding wheel e, and, accordingly, the slipper surface b was reciprocated on the polishing surface b of the rotating grinding wheel e.

Therefore, the width W of said grinding wheel e was set broader than the width w in the rotating direction of said slipper surface d.

In this method, however, the following demerits were involved.

(1) Since the width W of the grinding wheel e is broader than the width w of the slipper surface d, only the portion of the grinding surface b contacting with the slipper surface d is worn out, and the entire sectional shape in the axial direction of the grinding surface b gradually becomes different from the round shape of the slipper d. As a result, the remaining portion without being worn of the polishing surface b must be polished by truing to remake into the round surface in the same shape as the stripper surface d, and it requires labor and cost, which leads to reduction of job efficiency and elevation of manufacturing cost.

(2) On the polishing surface b of the grinding wheel e, the portion broader than the slipper d does not contribute to the roundness processing of the slipper surface d, and must be ground and removed by truing as mentioned above, so that the material of the grinding wheel is consumed purposelessly, which also leads to elevation of manufacturing cost.

(3) When machining plural types of rocker arm differing in the size of roundness (the radius of curvature) of the slipper surface d, it is necessary to exchange and use, on every machining, the grinding wheel e having the polishing surface b suited to the roundness shape of the intended slipper surface d, or reshape the polishing surface b of the grinding wheel e into a new roundness shape.

In the former process, spare grinding wheels to be replaced must be prepared as many as round shapes to be processed, and the cost required for this preparation is enormous. In the latter process, not only are the labor and cost for truing needed, but also the life of the grinding wheel e itself is shortened because of the wasteful polishing and removing.

(4) Of the above machining steps, most steps including the mounting and dismounting of the rocker arm c on and off the support shaft f, and reciprocal motion of the rocker arm c were manual works. Accordingly, particularly at mass production site, together with the problems of the shape of the grinding wheel e, the job efficiency was extremely poor, and it was difficult to reduce the manufacturing cost notably.

BRIEF SUMMARY OF THE INVENTION

This invention is devised in the light of the above conventional problems, and it is hence a primary object of the invention to present a novel roundness processing device for a slipper surface of a rocker arm capable of enhancing the job efficiency and reducing the manufacturing cost by solving the above problems.

It is other object of this invention to present a roundness processing device for a slipper surface of a rocker arm capable of rounding the slipper surface of the rocker arm without forming a round shape on the polishing surface of a grinding wheel.

It is a different object of this invention to present a roundness processing device for a slipper surface of a rocker arm which does not require exchange of grinding wheels or truing of the polishing surface of a grinding wheel even when changing the roundness dimensions of the slipper surface of the rocker arm.

It is a further different object of this invention to present a roundness processing device for a slipper surface of a rocker arm which is automated in a series of machining steps, including the conveyance of rocker arm, carrying into and out of the jig, and machining.

The roundness processing device for a slipper surface of a rocker arm of this invention is composed so that the wheel side unit including the disc-shaped grinding wheel, the jig side unit for holding and oscillating the rocker arm, the conveyor for conveying the rocker arm, and the access robot for moving in and out the rocker arm are automatically driven and controlled, as being mutually related, by automatic control such as numerical control. Moreover, the polishing surface of the grinding wheel is formed on a plane perpendicular to the rotational axial line of the grinding wheel, while the slipper surface of a rocker arm which is polished as being pressed to this polishing surface is designed to oscillate about the oscillation axial line positioned at a spacing of a specified roundness dimension from said polishing surface. The oscillation shaft line is parallel to the polishing surface and within a plane perpendicular to said polishing surface containing the contact line between said polishing surface and slipper surface.

While the novel features of the invention are set forth with particularity in the appended claims, the the invention, both as to organization and content, will be better understood and appreciated, along with other objects and features thereof, from the following detailed description taken in conjunction with the drawings.

DETAILED DESCRIPTION OF THE PREFERRED EMBODIMENT

Figure 1:
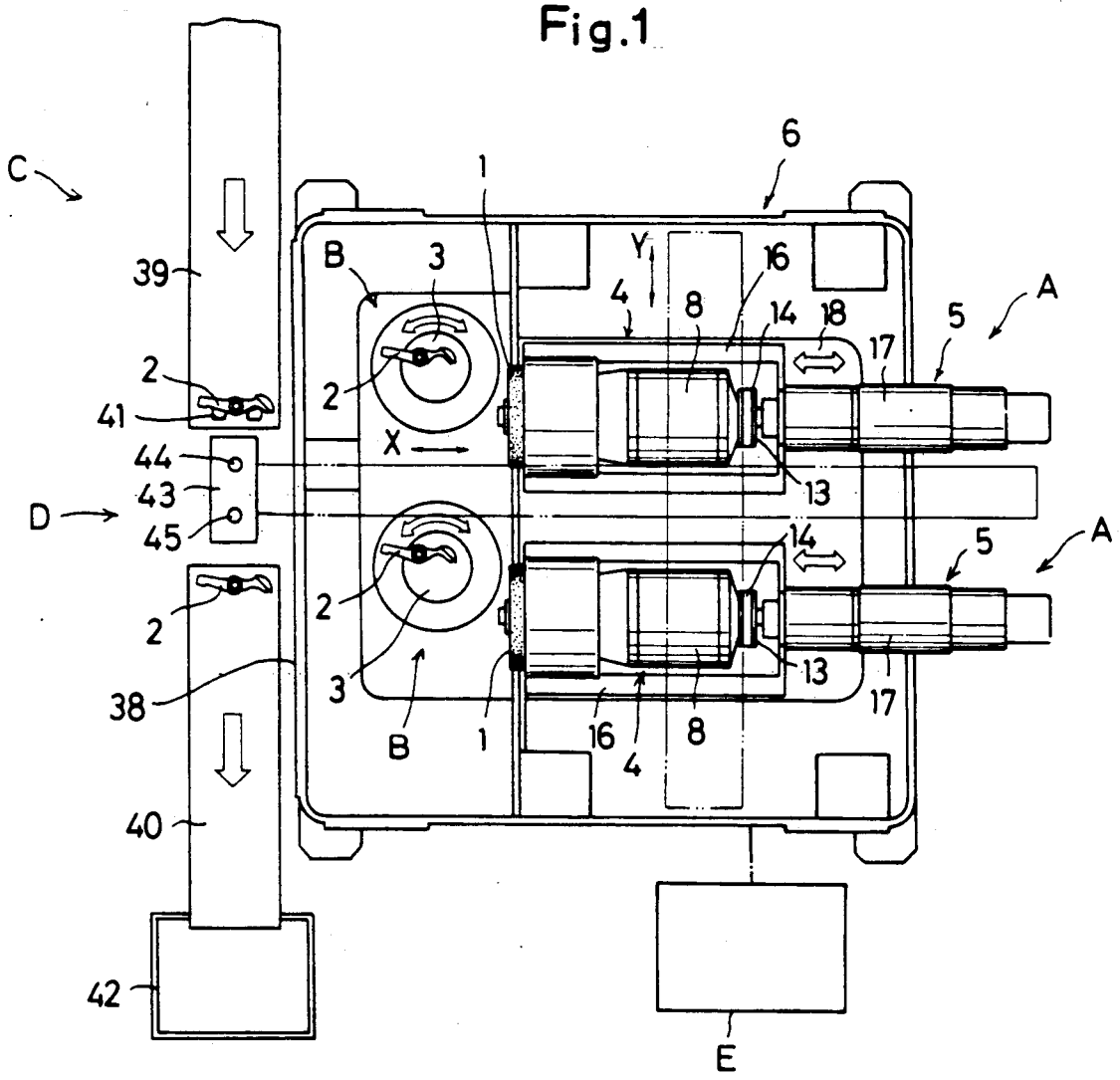
FIG. 1 is a schematic plan view of an entire roundness processing device for a slipper surface of a rocker arm according to one of the embodiments of the invention.

A roundness processing device for a slipper surface of a rocker arm according to one of the embodiments of the invention is shown in FIG. 1, in which the roundness processing device comprises a wheel side unit A containing a grinding wheel 1 which is rotated and driven, a jig side unit B containing an oscillatable jig 3 for holding a rocker arm 2, conveying means C for conveying the rocker arm 2, access means D for moving in and out the rocker arm 2 into and out of the jig 3, and automatic control means E for automatically driving and controlling them by mutually relating with each other.

Figure 2:
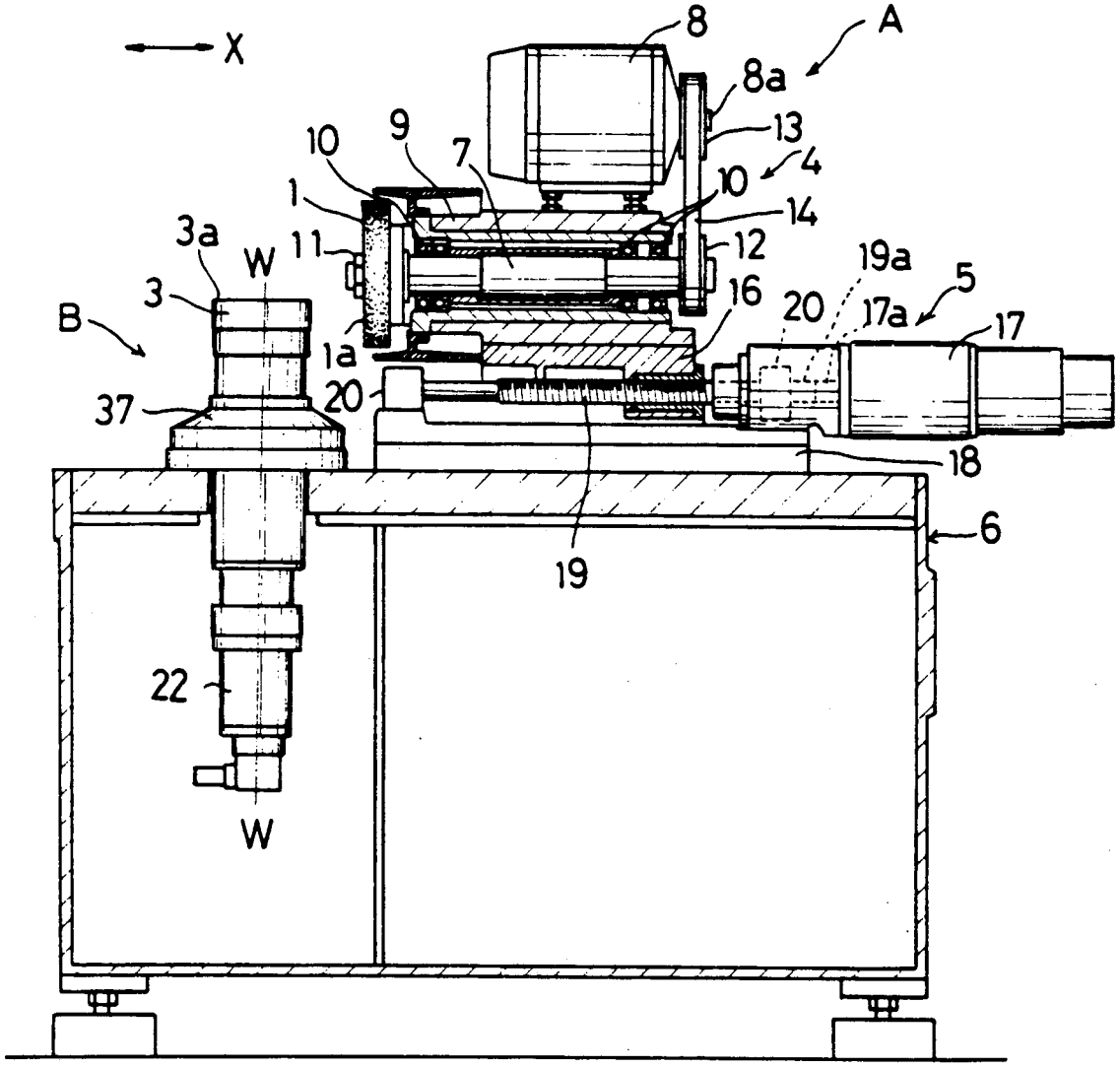
FIG. 2 is a front view showing a partial section of principal parts of the same roundness processing device.
Figure 4:
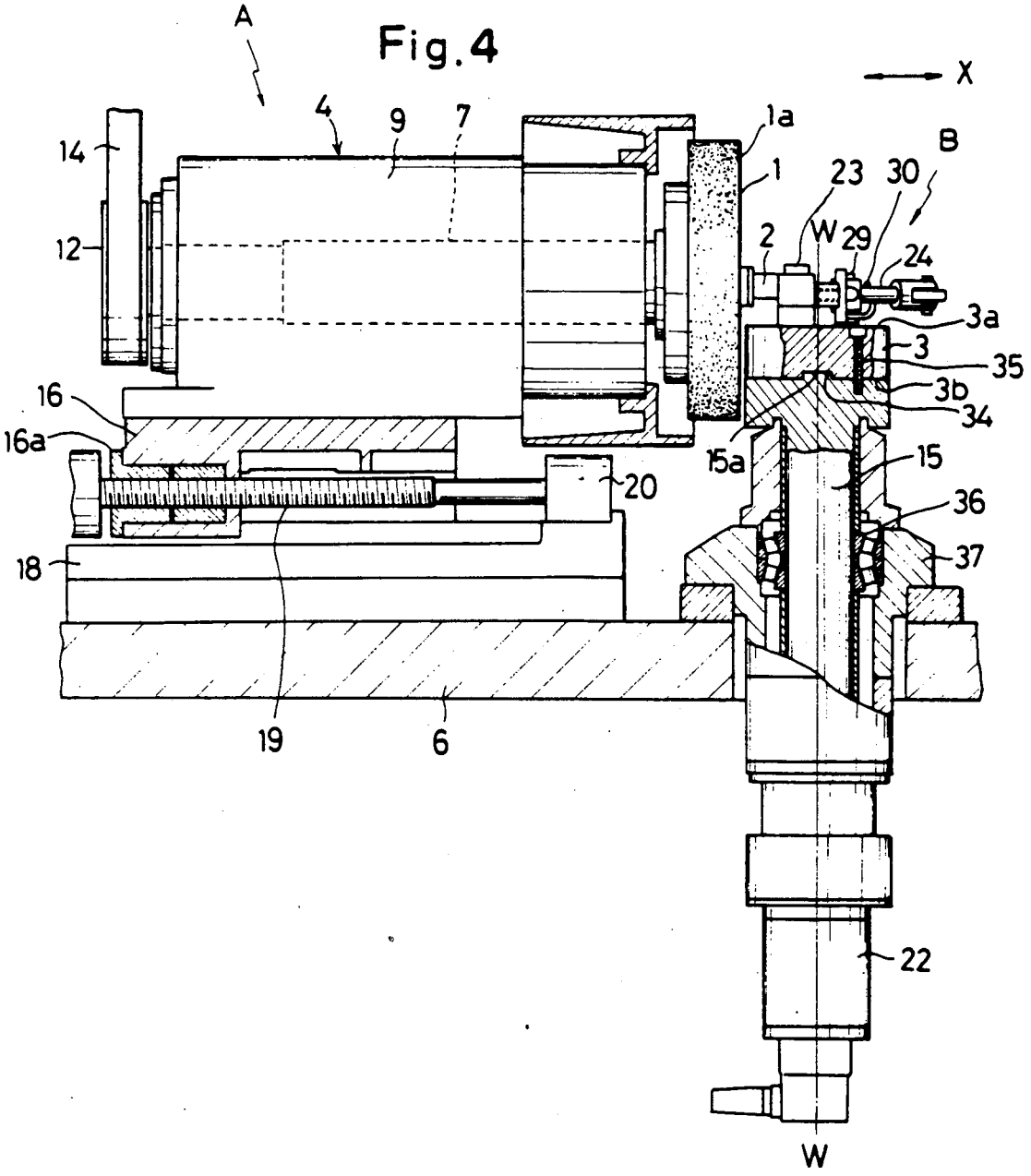
FIG. 4 is a front view showing the relation between the principal parts of the same roundness processing device and the rocker arm in a partial sectional view.

The wheel side unit A is composed of, as shown in FIG. 2 and FIG. 4, a main shaft unit 4 and an oscillation unit 5, and in the illustrated example, two wheel side units A are mounted on a base frame 6.

The main shaft unit 4 is to rotate and drive the grinding wheel 1, and it mainly comprises a rotary main shaft 7 and a main shaft motor 8. The rotary main shaft 7 is held on the main shaft main body 9 in the horizontal state in a rotatable manner through bearings 10 . . . as shown in FIG. 2. At the front end of the main rotary shaft 7, the grinding wheel 1 is detachably fitted by means of a tightening nut 11. At the rear end of the rotary main shaft 7, a timing pulley 12 is provided. The main shaft motor 8 is installed on the main shaft main body 9, and a timing pulley 13 is attached to its drive shaft 8*a*. This timing pulley 13 and the timing pulley 12 of the rotary main shaft 7 are linked together by way of a timing belt 14. As a result, the grinding wheel 1 is rotated and driven, together with the rotary main shaft 7, by the main shaft motor 8 through the timing belt 14.

The grinding wheel 1 is disc-shaped, and a polishing surface 1*a* is formed at its one side face. That is, the polishing surface 1*a* is a circular polishing surface formed on the entire one side face of the grinding wheel 1, and is a plane perpendicular to the axial line of the rotary main shaft 7.

The oscillation unit 5 is means for adjusting the interval variably between the polishing surface 1*a* of the grinding wheel 1 and the center line (the oscillation shaft line) of the oscillation shaft 15 of the jig 3, and mainly comprises a sliding base for supporting the main shaft unit 14, and a servo motor 17 for moving the sliding base 16 in a direction parallel to the rotary main shaft 7.

On the sliding base 16 is fixed the main shaft main body 9 of the main shaft unit 4. The sliding base 16 is allowed to slide on a stationary table 18 fixed on the base frame 6 in a direction parallel to the rotary main shaft 7. The sliding base 16 possesses a screw hole 16*a* extending in the horizontal direction, and a ball screw 19 is bonded into this screw hole 16*a* in a manner capable of spirally moving in and out relatively. The ball screw 19 is held on the stationary table 18 in a horizontal state in a rotatable manner through bearings 20, 20. One end 19*a* of the ball screw 19 is coupled to the drive shaft 17*a* of the servo motor 17 through a joint (not shown). Therefore, when the ball screw 19 is rotated in normal or reverse direction by the servo motor 17, the main shaft unit 4 is caused to slide reciprocally in the lateral direction in FIG. 2 and FIG. 4, together with the sliding base 17 spirally engaged with this ball screw 19, so that the infeed of the slipper surface 2*a* of the rocker arm 2 is adjusted. Meanwhile, this infeed is detected and controlled by reading the rotational angle of the drive shaft 17*a* of the servo motor 17 by means of a pulse encoder (not shown).

In the illustrated example, the sliding unit (the interval adjusting means) 5 is mounted on the wheel side unit A, and the main shaft unit 4 is designed to be movably adjusted, but it may be also possible to design, instead, to install the interval adjusting means on the jig side unit B to movably adjust the jig 3.

Figure 3:
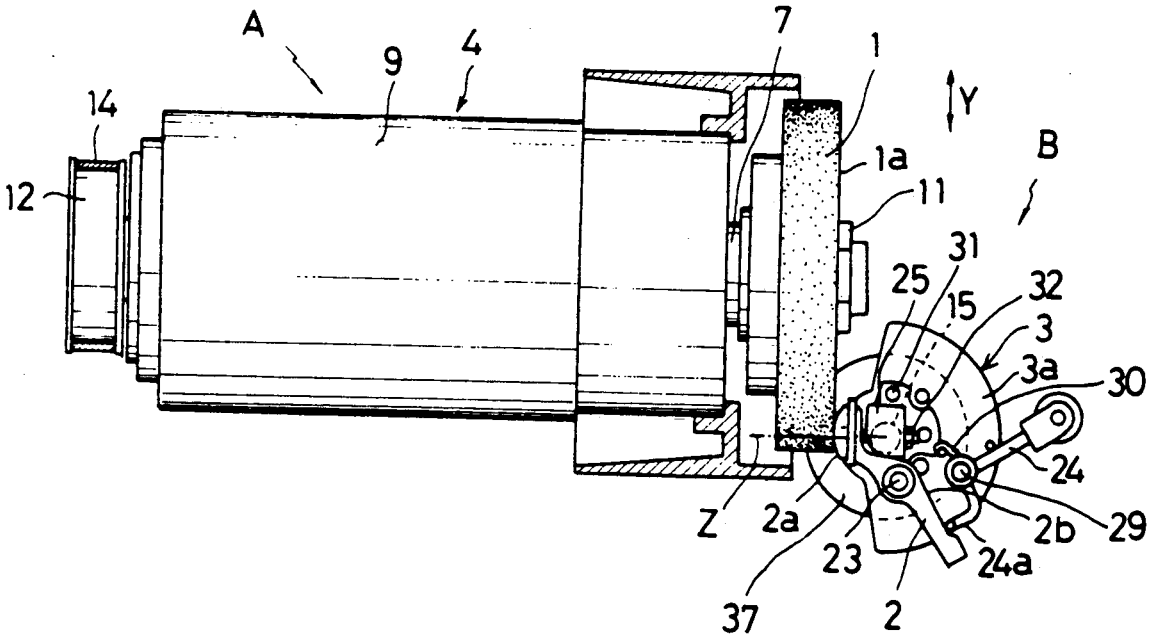
FIG. 3 is a plan view showing the relation between the principal parts of the same roundness processing device and the rocker arm in a partial sectional view.

The jig side unit B comprises mainly the oscillation shaft 15 and servo motor 22 as shown in FIG. 2 to FIG. 4. In the illustrated example, two jig side units B are mounted on the base frame 6, correspondingly to the wheel side units A, A.

The jig 3 has rocker arm holding means for positioning and holding the rocker arm 2. This rocker arm holding means is composed of, in the illustrated example, shaft member 23, pressing lever 23 and positioning member 25, and they are mounted on the top 3*a* of the jig 3.

The shaft member 23 projects upward from the top 3a of the jig 3, and a shaft hole 26 provided in the middle of the rocker arm 2 in the longitudinal direction is engaged with this shaft member 23, and the rocker arm 2 is rotatably pivoted on the jig 3 in the horizontal direction.

The pressing lever 24 and the positioning member 25 are installed at the back 2b side of the rocker arm 2, against the grinding wheel 1, on the top 3a of the jig 3.

The pressing lever 24 is, as shown in FIG. 3, pivoted on a pivot 29 projecting upward from the top 3a of the jig 3, and its front end 24a is stopped at the base end side portion of the back 2b of the rocker arm 2. Numeral 30 is a spring for thrusting the pressing lever 24 to the rocker arm 2 side, and one end of this spring 30 is held on the top 3a of the jig 3, while the other end is stopped at the pressing lever 24.

The positioning member 25 is fitted to the top 3a of the jig 3 by means of a plurality of screws 31 . . . , and the front end of the adjusting screw 32 engaged with the positioning member 25 is stopped on the slipper surface 2a side portion (front end side portion) of the back 2b of the rocker arm 2.

Therefore, the rocker arm 2 is thrust so as to rotate clockwise in FIG. 3 around the shaft member 23 by means of the pressing lever 24, and is supported at a specific position by means of the adjusting screw 32 of the positioning member 25, so that the slipper surface 2a is positioned to confront the polishing surface 1a of the grinding wheel 1. The position of the slipper surface 2a of the rocker arm 2 can be adjusted by screwing in or out the adjusting screw 32. This adjusting screw 32 is, after adjusting the position of the slipper surface 2a, held securely at that position by the setnut 33 engaging therewith.

At the bottom 3b of the jig 3, these is a shaft mounting hole 34 as shown in FIG. 4. The protrusion 15a provided at the upper end of the oscillation shaft 15 is fitted into this shaft mounting hole 34, and the oscillation shaft 15 and the jig 3 are integrally coupled together by means of a plurality of screws 35 . . . .

The oscillation shaft 15 is hold in the vertical state rotatably on a shaft holding member 37 attached to the base frame 6 by means of bearings 36 . . . . The lower end of the oscillation shaft 15 is linked to the drive shaft of the servo motor 22 through joint means (not shown). As a result, the slipper surface 2a of the rocker arm 2 hold on the jig 3 is reciprocally rotated within a preset angular range, about the central axial line W—W (see FIG. 4) of the oscillation shaft 15, by normal and reverse rotations of the oscillation shaft 15 by the servo motor. This angular range can be detected and controlled by reading the rotational angle of the drive shaft of the servo motor 22 by means of pulse encoder (not shown).

Figure 5:
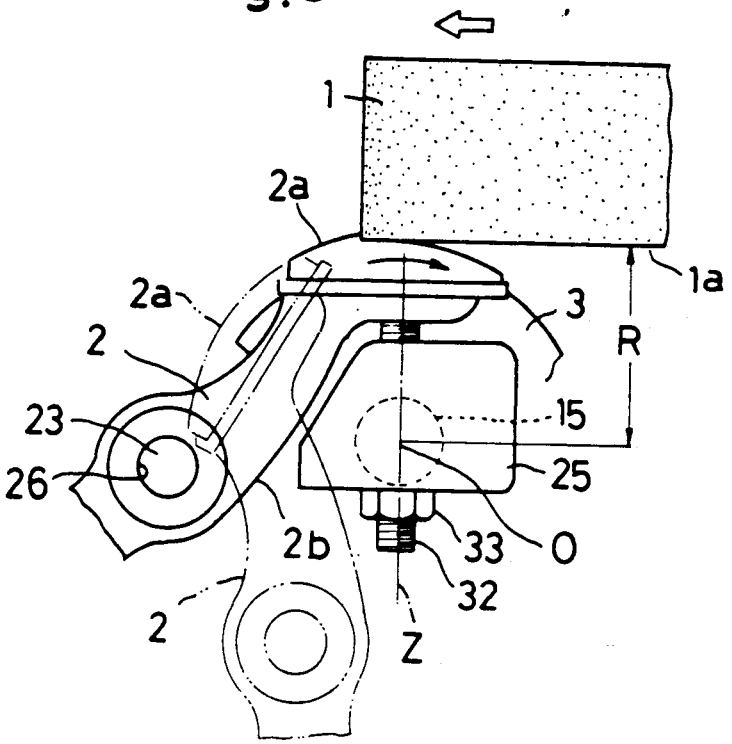
FIG. 5 is a plan view of essential parts showing the state of rough roundness processing on the slipper surface of the rocker arm by the same roundness processing device.
Figure 6:
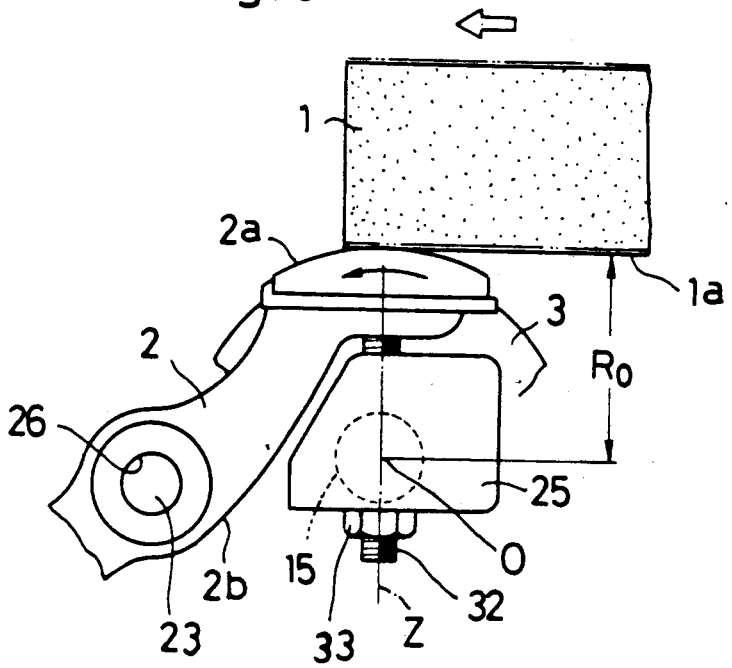
FIG. 6 is a plan view of essential parts showing the state of final roundness processing on the slipper surface of the rocker arm by the same roundness processing device.

The central axial line of the oscillation shaft 15 (the oscillation shaft line) W—W is parallel to the polishing surface 1a as shown in FIG. 4, and is so composed as to be perpendicular to the polishing surface 1a of the grinding wheel 1, as shown in FIGS. 3, 5, 6, and also within a perpendicular plane Z including the contact line (the line parallel to the widthwise direction of the slipper surface) of the polishing surface 1a and slipper surface 2a.

The conveying means C is disposed, as shown in FIG. 1, close to the edge 38 of the jig side unit B side of the base frame 6, and in the illustrated example, it is composed of a delivery conveyor 39 and a discharge conveyor 40 extending parallel to the edge 38.

The delivery conveyor 39 is to supply unprocessed rocker arms 2 sequentially into the access means D, and it is driven in the downward direction in FIG. 1. At the front end portion of the delivery conveyor, positioning stoppers 41, 41 are disposed, and the conveyed rocker arm 2 is stopped by these positioning stoppers so as to wait for a specific time in this place.

The discharge conveyor 40 is designed to receive and send out sequentially the processed rocker arms 2 supplied from the access means D, and is driven in the downward direction in FIG. 1 same as the delivery conveyor 39. At the front end portion of the discharge conveyor 40, a storage box 42 is installed, and the conveyed rocker arms 2 are sequentially put into this box.

Figure 12:
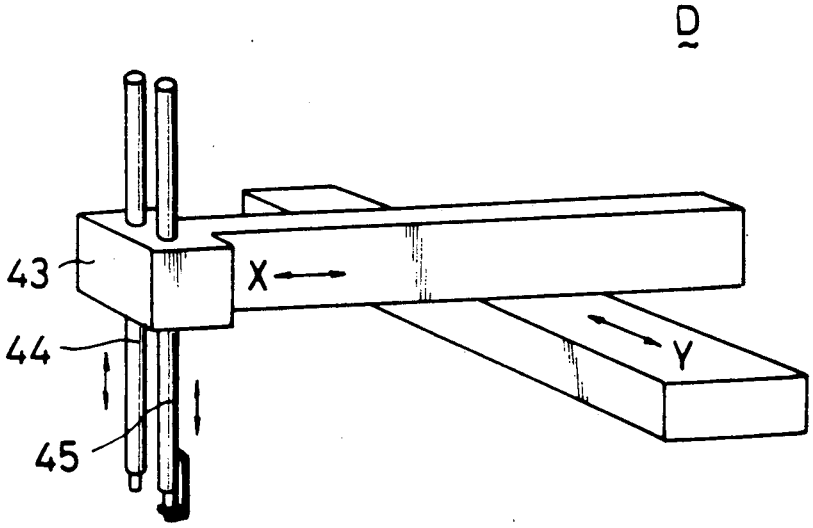
FIG. 12 is a schematic persepctive view showing an access robot of the same roundness processing device.

The access means D is an access robot designed to supply the unprocessed rocker arms 2 sent out from the delivery conveyor 39 into the jig 3, and to take them out of the jig 3, and it mainly comprises, as shown in FIG. 12, a moving table 43, and a delivery loader 44 and discharge loader 45 incorporated therein.

The moving table 43 is designed to move by the drive means (not shown) in the rotating direction of the grinding wheel (the X-direction in FIG. 1) and its vertical direction (the Y-direction in FIG. 1). This moving range is detected by a limit switch such as proximity switch (not shown).

The delivery loader 44 and discharge loader 45 are mounted on the moving table 43 in the vertical downward direction, and are moved among the two jigs 3, 3, and delivery conveyor 39 and discharge conveyor 40 in FIG. 1 by the movement of the moving table in the X-, Y-directions.

Figure 13A:
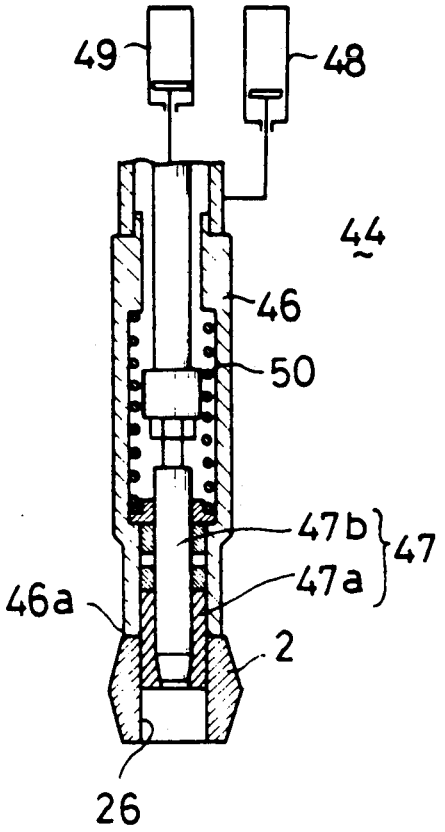
FIG. 13*a* and FIG. 13*b* are longitudinal sectional views showing the delivery loader of the same access robot, FIG. 13*a* showing the moment of chucking the rocker arm and FIG. 13*b* showing the moment of the setting of the rocker arm on the jig.
Figure 13B:
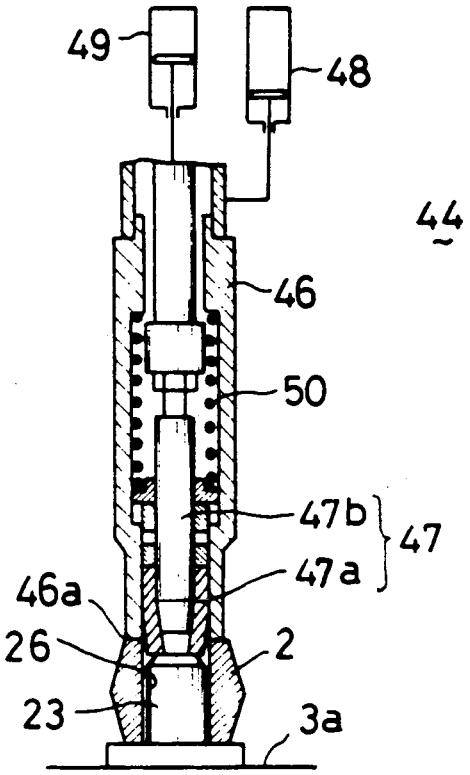

The delivery loader 44 mainly comprises, as shown in FIGS. 13a, 13b, a loader main body 46 elevatable about the moving table 43, a collet chuck mechanism 47 disposed at the front end (lower end) of the loader main body 46, an elevating cylinder 48 for raising and lowering the loader main body 46, and a work cylinder 49 for operating the collet chuck mechanism 47. The collet chuck mechanism 47 is composed of a collet 47a and a work rod 47b for extending it, and the work rod 47b is coupled with the work cylinder 49. The collet 47a is elastically thrust always downward by a spring 50.

Thus, in the chuck action of the rocker arm 2 by the delivery loader 44, first in FIG. 13a, the loader main body 46 is lowered by the projecting action of the elevating cylinder 48, and the collet 47a of the collet chuck mechanism 47 is inserted halfway into the shaft hole 26 in the unprocessed rocker arm 2 waiting on the delivery conveyor 39. In succession, by the projecting action of the work cylinder 49, the collet 47a is extended in the shaft hole 26, and the rocker arm 2 is chucked. In this chucked state, the loader main body 46 goes up by the in-out action of the elevating cylinder 48.

On the other hand, in the mounting action of the rocker arm 2 onto the jig 3 by the delivery loader 44 (the delivery action), first in FIG. 13b, the loader main body 46 is lowered while chucking the rocker arm 2 by the projecting action of the elevating cylinder 48, and just before the collet 47a hits against the shaft member 23 of the jig 3, the work cylinder 49 moves in and out to contract the collet 47a, so that the chucking force of the rocker arm 2 by the collet 47a is weakened. Consequently, when the elevating cylinder 48 further projects, the rocker arm 2 is pushed into the shaft member 23 by the lower edge 46a of the loader main body 46, and is set in place. In this case, the collet 47*a* is always abutting against the shaft member 23 by the thrusting force of the spring 50.

Figure 14A:
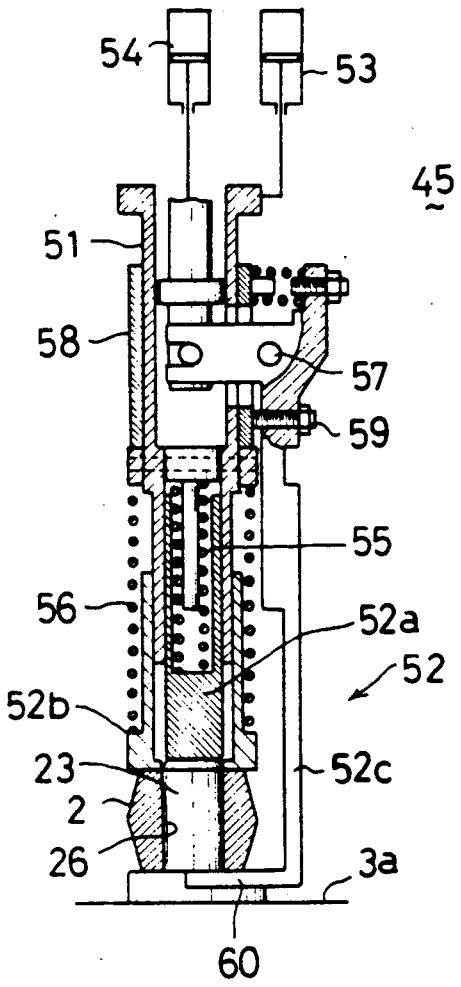
FIG. 14*a* and FIG. 14*b* are longitudinal sectional views showing the discharge loader of the same access robot, FIG. 14*a* showing the moment of chucking the rocker arm on the jig and FIG. 14*b* showing the meoment of discharge of the rocker arm from the jig.
Figure 14B:
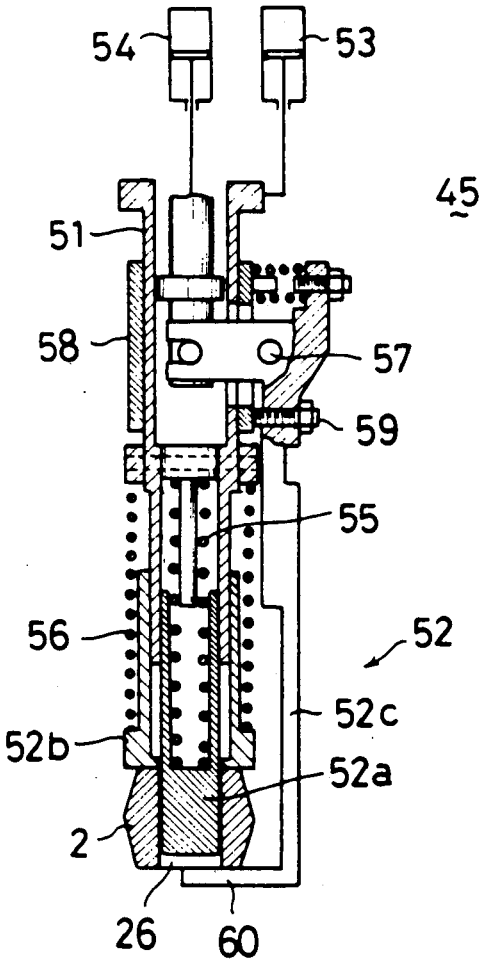

The discharge loader 45 comprises, as shown in FIGS. 14*a*, 14*b*, a lower main body 51 elevatable on the moving table 43, a chuck mechanism 52 disposed at the front end (lower end) of the loader main body 51, an elevating cylinder 53 for elevating the loader main body 51, and a work cylinder 54 for moving the chuck mechanism 52. The chuck mechanism 52 is composed of a sliding pin 52*a*, a holder tube 52*b*, and an L-shaped chuck pawl 52*c*. The sliding pin 52*a* is disposed oscillatably in the vertical direction in the loader main body 51, and is elastically thrust downward by a spring 55. The holder tube 52*b* is oscillatably mounted in the vertical direction on the loader main body 51, and is elastically thrust downward by a spring 56. Slip-out of this holder tube 52*b* from the loader main body 51 is checked by a stopper (not shown). The chuck pawl 52*c*has its upper end oscillatably pivoted on a support tube 58 by a support shaft 57, and is coupled to the work cylinder 54. Numeral 59 denotes a positioning stopper.

Thus, the chuck action of the rocker arm 2 by the discharge loader 45 is effected as shown in FIG. 14*a*; that is, first by the projecting action of the elevating cylinder 53, the loader main body 51 is lowered until the sliding pin 52*a* of the chuck mechanism 52 elastically abuts against the upper end of the shaft member 23 of the jig 3. At the same time, the lower end of the holder tube 52*b* elastically abuts against the top of the processed rocker arm 2 which is held on the shaft member 23. Next, by the in-out action of the work cylinder 54, the chuck pawl 52*c* oscillates about the support shaft 57, and its front end portion 60 is inserted into the lower side of the rocker arm 2. At this time, the positioning stopper 59 abuts against the support tube 58 to position the chuck pawl 52*c*. When the work cylinder 54 further moves in and out, and chuck pawl 52*c* elevates together with the support tube 58 while keeping the same position. As a result, the rocker arm 2 is also lifted in the state being pinched between the front end portion 60 of the chuck pawl 52*c* and the holder tube 52*b*, and by this elevating action, the sliding pin 52*a* is inserted into the shaft hole 26 in the rocker arm 2, and the rocker arm 2 is chucked. In this chucked state, the loader main body 51 goes up by the in-out action of the elevating cylinder (see FIG. 14*b*).

On the other hand, in the discharge action of the rocker arm 2 onto the discharge conveyor 40 by the discharge loader 45, first the loader main body 51 is lowered by the projecting action of the elevating cylinder 53. Next, by the projecting action of the work cylinder 54, the chuck pawl 2 is lowered together with the support tube 58 while keeping the same position. As a result, the rocker arm 2 is also lowered as being pinched between the front end portion 60 of the chuck pawl 52*c* and the holder tube 52*b*, and by this descending action, the sliding pin 52*a* is relatively drawn out of the shaft hole 26 in the rocker arm 2 (that is, slipped out). When the work cylinder 54 further projects, the chuck pawl 52*c* oscillates about the support shaft 57, and its front end portion 60 is displocated from the lower side of the rocker arm 2. In consequence, the rocker arm 2 is pressed by the holder tube 52*b*, and is mounted on the discharge conveyor 40.

The automatic control means E is practically a numerical controller, and is housed in a control box (not shown). By the inputs of required numerical data through an operation panel on the control box, the actuators of the wheel side unit A, jig side unit B, conveying means C, access means (access robot) D, and automatic control means E are driven and controlled as being related with each other.

The roundness processing method of the slipper surface 2*a* of the rocker arm 2 by the device of this invention composed in this manner is explained below.

1. When an unprocessed rocker arm (work) 2 is put on the delivery conveyor 39 either manually or automatically, each rocker arm 2 is conveyed in the downward direction in FIG. 1 by means of the delivery conveyor 39.

2. The conveyed rocker arm 2 is positioned by the positioning stopper 41 at the front end portion of the delivery conveyor 39, and waits at this position.

3. The delivery loader 44 for the access robot D moves upward of the positioning stopper 41, and chucks and elevates the rocker arm 2 waiting on the delivery conveyor 39 by the operation described herein (see FIG. 13*a*).

4. The discharge loader 45 of the access robot D moves upward of the jig 3 of the jig side unit B at the upper side in FIG. 1, and chucks and elevates the processed rocker arm 2 on the jig 3 by the operation described herein (see FIGS. 14*a*, 14*b*).

5. The delivery loader 44 is moved upward of the jig 3, and sets the unprocessed rocker arm 2 chucked at step 3 onto the jig 3 (see FIG. 13*b*).

The unprocessed rocker arm 2 set on the jig 3 is rounded in the subsequent grinding process as described below.

6. On the other hand, the discharge loader 45 is moved upward of the discharge conveyor 45, and puts the processed rocker arm 2 chucked at step 4 onto the discharge conveyor 40 by the operation described herein.

7. The processed rocker arm 2 put on the discharge conveyor 40 is put into the storage box 42 as a completed product.

8. Steps 2 to 7 are repeated, and this time, as shown in FIG. 1, the roundness processing step is executed by the lower side wheel side unit A and the jig side unit B.

9. Thereafter steps 2 to 8 are repeated.

The grinding step 5 is described in detail below.

i) The grinding wheel 1 is moved to the grinding position by the sliding unit 5.

ii) The grinding wheel 1 is rotated and driven by the main shaft motor 8 of the wheel side unit A (the main shaft motor 8 is always driving during the grinding process), while the servo motor 22 of the jig side unit B is started, so that the jig 3 is reciprocally rotated at a constant speed in the direction of the grinding wheel 1 (in the clockwise direction in FIG. 5), about the axial center 0 of the oscillation shaft 15 (the oscillation shaft line W—W).

Consequently, the slipper surface 2*a* of the rocker arm 2 rotated about the axial center 0 is roughly finished to a roundness with the radius of curvature of R by the polishing surface 1*a* of the grinding wheel 1.

At the moment of completion of this rough finish, the slipper surface 2*a* is positioned at a distance from the polishing surface 1*a* of the grinding wheel 1 in the clockwise direction in FIG. 5.

iii) When rough finishing is over, the grinding wheel 1 is moved by the sliding unit 5 by the portion of the finishing allowance, for example 0.02 mm, in the direction of the jig 3 (to the right in FIG. 3), and is located at the finish grinding position.

iv) On the other hand, as stated above, when the slipper surface 2a is departed from the polishing surface 1a, the oscillation shaft 15 is changed over in the rotating direction into the opposite direction (the counterclockwise direction in FIG. 5) by the servo motor 22 according to predetermined conditions, and is reciprocally rotated at a constant speed, and this reciprocal rotation is stopped when the jig 3 returns to the same waiting position (the position indicated by double dot chain line in FIG. 5).

By this reciprocal rotation, as shown in FIG. 6, the slipper surface 2a of the rocker arm 2 is polished by the portion of the finishing allowance by the polishing surface 1a, and is finished to the specified roundness Ra.

This operation refers to one session each of rough grinding and finish grinding, but where the grinding allowance of the slipper surface 2a is larger, each operation of i) and ii) may be repeated proper times.

In this way, as the rocker arm 2 is oscillated about the oscillation shaft 15 against the polishing surface 1a of the rotating grinding wheel 1, a specific roundness having the radius of curvature Ra may be easily formed on the slipper surface 2a of the rocker arm 2.

Moreover, when the size of the roundness formed on the slipper surface 2a is changed, by moving the wheel side unit A by the sliding unit 5, the distance between the center of oscillation 0 of the rocker arm 2 and the polishing surface 1a of the grinding wheel 1 is set to a new desired roundness dimension. Therefore, roundnesses of various sizes can be freely formed by using the same grinding wheel 1 on the slipper surface 2a, and it is not necessary, as experienced in the conventional roundness forming technique, to replace with a spare grinding wheel on which a polishing surface of a desired roundness is formed on the outer circumference, or form a polishing surface of a new roundness size on the outer circumference of the grinding wheel in use by truing.

Figure 15:
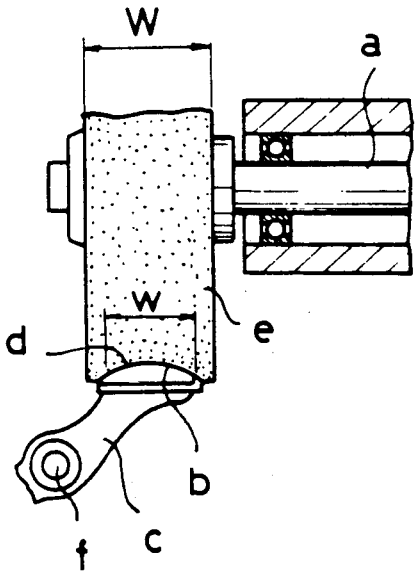
FIG. 15 is a plan view showing a partial sectional view of a conventional roundness processing device for a slipper surface of a rocker arm.

In case the polishing surface 1a of the grinding wheel 1 is worn out, the center of oscillation 0 of the jig 3 is slightly moved toward the radial center direction of the grinding wheel 1, and the slipper surface 2a of the rocker arm 2 abuts against a new polishing surface 1a not worn out, or the opposite side of the polishing surface 1a of the grinding wheel 1 confronts the rocker arm 2 side, by properly re-mounting the grinding wheel 1, so that the slipper surface 2a may be rounded multiple times by the same grinding wheel 1. Therefore, as compared with the conventional case of forming a round polishing surface on the outer circumference of the grinding wheel (FIG. 15), the life of the grinding wheel 1 may be extremely extended, and the processing cost of the slipper surface 2a may be reduced notably.

Figure 7:
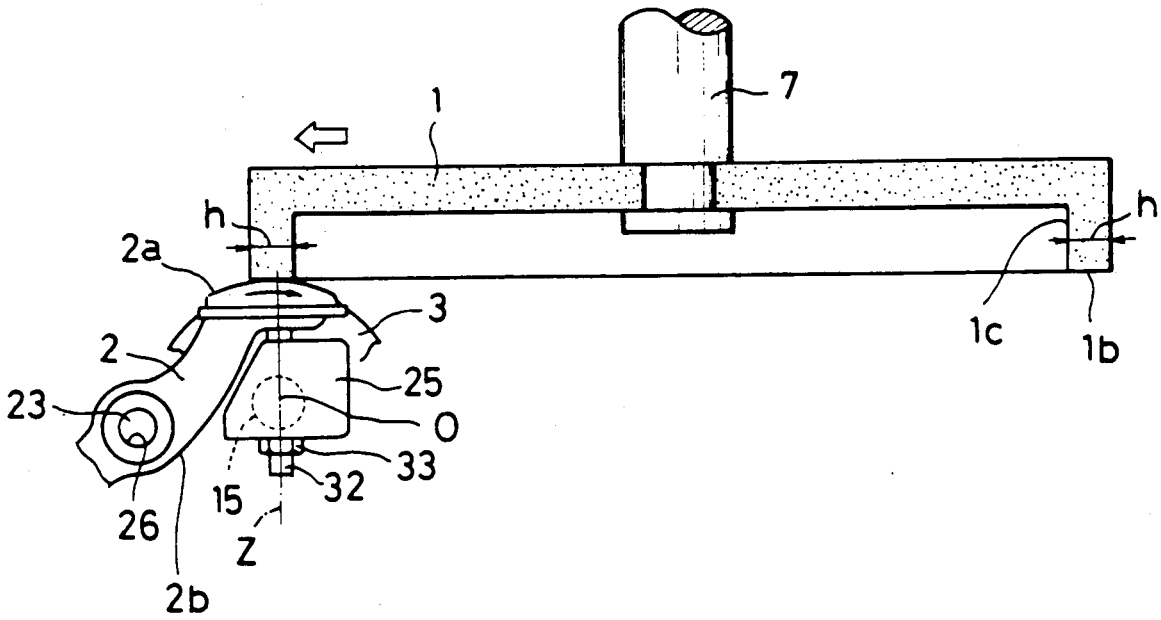
FIG. 7 is a plan view showing a modified example of the grinding wheel in the same roundness processing device in the relation the the slipper surface of the rocker arm.

FIG. 7 shows other embodiment of the invention, in which the structure of the grinding wheel in the embodiments shown in FIGS. 3, 6 is modified.

More specifically, a recess 1c in a shape of circular cylinder or circular truncated cone is formed at one side of the grinding wheel 1, and an annular polishing surface 1b possessing a specified polishing surface width (radial width) h is formed on the outer periphery of the same side.

This polishing surface width h is determined so that the entire widthwise direction of the slipper surface 2a (the direction vertical to the paper surface in FIG. 7) may be polished linearly, and its setting condition is determined as follows.

Figure 8:
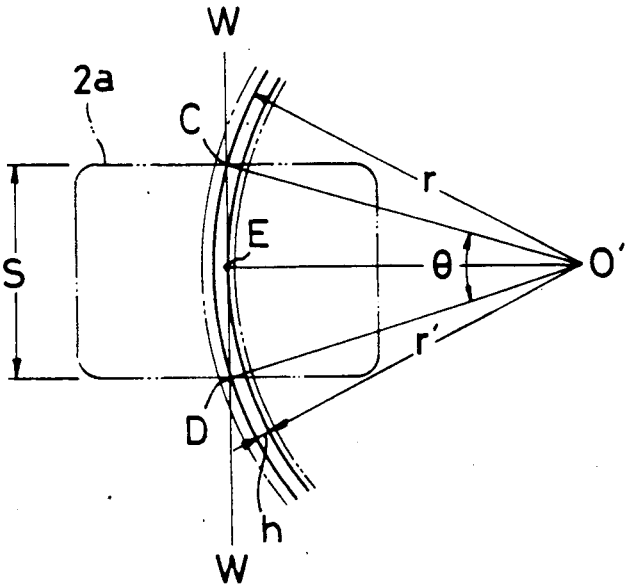
FIG. 8 is an explanatory drawing for showing the setting condition of the width of the polishing surface of an annular polishing surface of the grinding wheel shown in FIG. 7.

In FIG. 8, S denotes the width of the slipper surface 2a, and the line W—W represents the central axial line of the oscillating shaft 15 (oscillating shaft line).

In order that the slipper surface 2a may be polished linearly entirely in its widthwise direction, supposing the intersecting points of the outside diameter of the annular polishing surface 1b with the contour lines of both the ends in the widthwise direction of the slipper 2a to be respectively C, D, and the contacting point of the inside diameter with the central axial line W—W of the oscillating shaft 15 to be E, it is sufficient when the points C, D are present on the central axial line W—W.

When this condition is satisfied, the polishing surface width h is as follows, supposing the center of rotation of the grinding wheel to be O', the outside diameter of the annular polishing surface 1b to be 2r, its inside diameter to be 2r', and ΔCO'D which is the center angle of the grinding wheel 1 including the two points intersecting with contour lines at both ends in the widthwise direction of the slipper surface 2r by the outside diameter line of the annular polishing surface 1b to be $\theta$; that is, from the right angle ΔCEO', it follows that $$r' = r \cos \theta/2,$$

$$h = r - r' = r(1\ 0 \cos \theta/2)$$

or, from $\cos \theta/2 = \cos^2, \theta/4 - \sin^2 \theta/4$, it follows that $$h = 2r \sin^2 \theta/4.$$

Therefore, when r and $\theta$ are determined, the polishing surface width h can be calculated in one of the above equations.

Usually, considering that the surface contact at a slight width takes places (nearly a line contact) due to elastic deformation of the grinding wheel 1 and slipper surface 2a at the contacting portions, the polishing surface width h is determined by setting r slightly larger and r' slightly smaller (for example, about 0.5 mm) than the condition shown in FIG. 6, to be about 2.5 mm (see the double dot chain line width in FIG. 8).

Figure 9A:
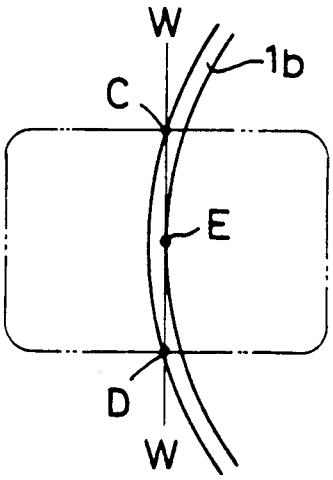
FIG. 9*a*, FIG. 9*b*, FIG. 10*a*, FIG. 10*b*, and FIG. 11*a*, FIG. 11*b* are explanatory drawings for showing the effects of the contacting position of the annular polishing surface of the grinding wheel in FIG. 7 with the slipper surface of the rocker arm, on the sectional shape in the axial direction of the slipper.
Figure 9B:
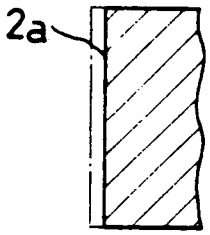

Therefore, when the grinding wheel 1 is composed as shown in this embodiment, the annular polishing surface 1b of the grinding wheel 1 contacts nearly linearly with the entire slipper surface 2a in the widthwise direction in a straight line parallel to the central axial line W—W of the oscillating shaft 24, so that a round surface with a radius Ro around the center of rotation of the oscillating shaft 15 may be formed on the slipper surface 2a while keeping a linear state entirely in the widthwise direction (see FIG. 9b).

What is more, since the polishing surface width h of this annular polishing surface 1b is determined around 2.5 mm and is sufficiently smaller than the length of the slipper surface 2a in the rotating direction, the annular polishing surface 1b is worn in the same shape as the round shape of the slipper surface 2a. Accordingly, if the annular polishing surface 1b of the grinding wheel 1 is gradually worn, the slipper surface 2a may be processed in a round shape 2a without being trued again.

The polishing surface width h of the annular polishing surface 1b is sufficiently small also in comparison with the distance R, Ro between the center 0 of rotation of the oscillating shaft 24 and the annular polishing surface 1b, and the surface is kept nearly flat even when worn, and therefore if the dimension of roundness to be formed on the slipper surface 2a is changed, roundness of various dimensions may be formed on the slipper surface 2a only by varying said distance R, Ro without having to replace the grinding wheel 1.

Moreover, when the polishing surface width h of the grinding wheel 1 is selected properly, the quantity of material used in the grinding wheel 1 may be saved, and it is economical. Still more, since it is not necessary to true the annular polishing surface 1b of the grinding wheel as mentioned above, it is possible to use a Borazon grinding wheel as the grinding wheel 1, so that the life of the grinding wheel 1 may be extended.

Figure 10A:
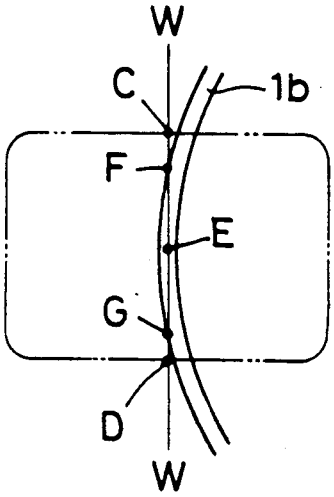
Figure 10B:
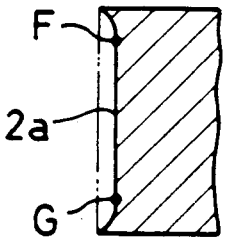
Figure 11A:
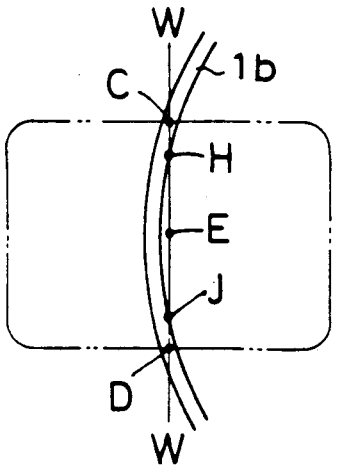
Figure 11B:
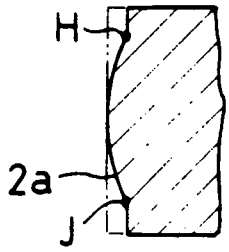

Furthermore, in the case of the grinding wheel 1 of this composition, when the configuration of the polishing surface with h of the annular grinding wheel 1b and the central axial line (oscillating shaft line) W—W of the oscillating shaft 15 is changed as shown in FIG. 10a and 11a, the sectional shape of the slipper surface 2a in the widthwise direction becomes as shown in FIG. 10b and FIG. 11b, respectively. This is because in FIG. 10a the slipper surface 2a is polished as it contacts with the annular polishing surface 1b between F and G on the line W—W and is not polished as it does not contact between FC and GD, while in FIG. 11a it is polished as it contacts between CH and JD and is not polished as it does not contact between H' and J.

In the above embodiments, in the roundness processing of the slipper surface 2a of the rocker arm 2, it is explained that the rocker arm 2 is rotatably held on the shaft member 11 through the shaft hole 26, while the rocker arm 2 is fixed at a specified position of the jig 3 by the pressure lever 15 and positioning member 25, but it is also evident that the same roundness processing of the slipper surface 2a is possible by holding the rocker arm on the jig 3 by other means without disposing the shaft hole 26 in the rocker arm 2.

Besides, the roundness processing device in the illustrated examples is designed for large-scale mass production by completely automating a series of processes including the conveyance of the rocker arm, delivery into the jig, discharge, and processing, by numerical control, but in small-scale small production, for example, instead of the access robot D, a semiautomatic system may be composed by using a manual feeder (not shown) for setting the rocker arm 2 on the jig 3 manually.

As will be understood from the detailed description herein, according to this invention, the following excellent effects, among others, are obtained.

(1) Since the slipper surface of the rocker arm is oscillated around the oscillating shaft center positioned at a spacing of a specified roundness dimension from the polishing surface while being pressed to the polishing surface formed on a plane perpendicular to the rotary shaft line of the grinding wheel, the slipper surface polished by said polishing surface is formed in a round shape at the radius of curvature of said roundness dimension, and the polishing surface is always worn in a flat plane.

Therefore, the truing process to compensate for the gradual wear of the polishing surface which was indispensable in the prior art of forming the polishing surface in a round shape is not needed. As a result, the labor and cost for this process are saved, which can effectively prevent lowering of job efficiency and elevation of manufacturing cost.

(2) Besides, since the entire polishing surface contributes to the roundness processing of the slipper surface, the grinding wheel material is not wasted, which can save expenses and reduce the manufacturing cost.

(3) In the device of this invention, either the grinding wheel side unit or the jig side unit is furnished with an interval adjusting means for varying the interval between the polishing surface of the grinding wheel and the oscillating shaft line of the oscillating shaft of the jig.

Therefore, only by changing the distance between said polishing surface and said oscillating shaft line, the round surface in various dimensions of the slipper surface of the rocker arm can be freely formed, and when changing the dimension of roundness of the slipper surface, it is not necessary to exchange the grinding wheel or true the polishing surface of the grinding wheel.

Therefore, unlike the prior art, it is not necessary to prepare as many spare grinding wheels as round shapes to be processed, or spend labor and cost for truing, so that the expenses can be saved in this respect, too.

(4) In the device of this invention, by introducing the automatic control such as numerical control, a series of processing steps is completely automated, including the conveyance of rocker arm, delivery into jig, discharge and processing, the job efficiency is extremely high, particularly in the mass production field, together with the advantages of the shape of the grinding wheel, and the manufacturing cost may be significantly reduced.

The above embodiments in the detailed description of this invention are only intended to clarify the technical contents of the invention, and this invention should not be interpreted in a narrow sense limiting it only to the above embodiments, but should be interpreted in a wider sense as being modified within the scope of the true spirit and the claims of this invention.

What is claimed is:

1. A roundness processing device for a slipper surface of a rocker arm, the device comprising:

a wheel side unit containing a disc-shaped grinding wheel which is rotated and driven, a jig side unit comprising an oscillatable jig for holding the rocker arm, means for conveying rocker arms, means for delivering and discharging the rocker arm conveyed by the conveying means into and out of the jig in the jig side unit, wherein the delivering and discharging means is a delivering and discharging robot comprising a moving table movable in the direction of the rotary shaft of the grinding wheel and a delivery loader and a discharge loader mounted on the moving table, and means for automatically driving and controlling the wheel side unit, jig side unit, and delivering and discharging means in mutual relationship, wherein the grinding wheel comprises a polishing surface, which is a plane perpendicular to an axial line of the grinding wheel rotary shaft, at one side, the jig in the jig side unit comprises rocker arm holding means for holding the slipper surface of the rocker arm opposite the polishing surface, the jig comprises an oscillation shaft parallel to the polishing surface, the oscillation shaft being arranged within a plane perpendicular to the polishing surface containing a contact line between the polishing surface and slipper surface, the oscillation shaft is coupled with means for oscillating the jig within a preset angular range, either one of the wheel side unit and the jig side unit contains interval adjusting means for variably adjusting the interval between the polishing surface of the grinding wheel and the oscillation shaft line of the jig, and the device is capable of processing the slipper surface of the rocker arm to a high degree of dimensional precision.

2. A roundness processing device for a slipper surface of a rocker arm according to claim 1, wherein:

the interval adjusting means is disposed in the wheel side unit, and this interval adjusting means is a sliding unit comprising a sliding base for supporting a main shaft unit including the grinding wheel, and a servo motor for sliding the sliding base in the direction of the rotary shaft of the grinding wheel.

3. A roundness processing device for a slipper surface of a rocker arm according to claim 1, wherein:

the automatic control means comprises a numerical controller.

4. A roundness processing device for a slipper surface of a rocker arm according to claim 1, wherein:

the polishing surface is a circular polishing surface formed on an entire surface at one side of the grinding wheel, and the oscillation shaft is movable in the radial direction of the polishing surface orthogonal to the contact line between the polishing surface and slipper surface.

5. A roundness processing device for a slipper surface of a rocker arm according to claim 1, wherein:

the polishing surface is an annular polishing surface formed on an entire periphery of the outer circumference at one side of the grinding wheel, in a specific polishing surface width.

6. A roundness processing device for a slipper surface of a rocker arm according to claim 5, wherein:

the polishing surface width h of the annular polishing surface is expressed as follows, supposing the outside diameter of the annular polishing surface to be 2r, and a center angle of the grinding wheel including two points intersecting contour lines at both ends in a widthwise direction of the slipper surface by an outside diameter line of the annular polishing surface to be $\theta$:

$$h=2r\sin^2\theta/4.$$

7. A roundness processing device for a slipper surface of a rocker arm according to claim 1, wherein:

the holding means of the rocker arm comprises a shaft member, pressing lever and positioning member which are mounted on the top of the jig, the shaft member is fitted into a shaft hole provided in a middle position of the rocker arm in a longitudinal direction so as to rotatably pivot the rocker arm, the pressing lever is stopped at one end of a back side of the rocker arm so as to elastically thrust this end portion to the grinding wheel side, and the positioning member comprises an adjusting screw engaged therewith, and the front end of this adjusting screw is stopped at an opposite side portion of the back side of the rocker arm.

8. A roundness processing device for a slipper surface of a rocker arm comprising:

a wheel side unit containing a disc-shaped grinding wheel which is rotated and driven, and a jig side unit containing an oscillatable jig for holding the rocker arm, wherein the grinding wheel comprises a polishing surface which is a plane perpendicular to the axial line of the grinding wheel rotary shaft, at one side, the polishing surface is an annular polishing surface formed on an entire periphery of the outer circumference at one side of the grinding wheel, in a specific polishing surface width h, the polishing surface width h is, supposing the outside diameter of the annular polishing surface to 2r, and a center angle of the grinding wheel including the points intersecting contour lines at both ends in a widthwise direction of a surface of the slipper by the outer diameter line of the annular polishing surface to be $\theta$, expressed as $h=2r\sin^2\theta/4$, the jig in the jig side unit comprises rocker arm holding means for holding the slipper surface of the rocker arm oppositely to the polishing surface, the jig comprises an oscillation shaft parallel to the polishing surface, the oscillation shaft being arranged within a plane perpendicular to the polishing surface containing a contact line between the polishing surface and slipper surface, the oscillation shaft is coupled with means for oscillating the jig within a preset angular range, and either one of the wheel side unit and the jig side unit contains interval adjusting means for variably adjusting the interval between the polishing surface of the grinding wheel and the oscillation shaft line of the jig.

9. A roundness processing device for a slipper surface of a rocker arm, the device comprising:

a wheel side unit containing a disc-shaped grinding wheel which is rotated and driven, a jig side unit comprising an oscillatable jig for holding the rocker arm, means for conveying rocker arms, a movable table which supports means for delivering and means for discharging the rocker arm conveyed by the conveying means into and out of the jig in the jig side unit, the means for delivering and means for discharging the rocker arm being disposed at separate locations on the movable table, the means for delivering and means for discharging including respective chuck mechanisms for elastically abutting an upper end of a shaft member of the jig side unit through a shaft hole in the rocker arm, and means for automatically driving and controlling the wheel side unit, jig side unit, and delivering and discharging means in mutual relationship, wherein the grinding wheel comprises a polishing surface, which is a plane perpendicular to an axial line of the grinding wheel rotary shaft, at one side, the jig in the jig side unit comprises rocker arm holding means for holding the slipper surface of the rocker arm opposite the polishing surface, the jig comprises an oscillation shaft parallel to the polishing surface, the oscillation shaft being arranged within a plane perpendicular to the polishing surface containing a contact line between the polishing surface and slipper surface, the oscillation shaft is coupled with means for oscillating the jig within a preset angular range, and either one of the wheel side unit and the jig side unit contains interval adjusting means for variably adjusting the interval between the polishing surface of the grinding wheel and the oscillation shaft line of the jig.

10. A roundness processing device for a slipper surface of a rocker arm, the device comprising:

a wheel side unit containing a disc-shaped grinding wheel which is rotated and driven, a jig side unit comprising an oscillatable jig for holding the rocker arm, means for conveying rocker arms, means for delivering and discharging the rocker arm conveyed by the conveying means into and out of the jig in the jig side unit, and means for automatically driving and controlling the wheel side unit, jig side unit, and delivering and discharging means in mutual relationship, wherein the grinding wheel comprises a polishing surface, which is a plane perpendicular to an axial line of the grinding wheel rotary shaft, at one side, the jig in the jig side unit comprises rocker arm holding means for holding the slipper surface of the rocker arm opposite the polishing surface, the jig comprises an oscillation shaft parallel to the polishing surface, the oscillation shaft being arranged within a plane perpendicular to the polishing surface containing a contact line between the polishing surface and slipper surface, the oscillation shaft is coupled with means for oscillating the jig within a preset angular range, either one of the wheel side unit and the jig side unit contains interval adjusting means for variably adjusting the interval between the polishing surface of the grinding wheel and the oscillation shaft line of the jig, the device is capable of processing the slipper surface of the rocker arm to a high degree of dimensional precision, and the polishing surface is an annular polishing surface formed on an entire periphery of the outer circumference at one side of the grinding wheel, in a specific polishing surface width h which is expressed as follows, supposing the outside diameter of the annular polishing surface to be 2r, and a center angle of the grinding wheel including two points intersecting contour lines at both ends in a widthwise direction of the slipper surface by an outside diameter line of the annular polishing surface to be $\theta$:

$$h=2r\sin^2\theta/4.$$

11. A roundness processing device for a slipper surface of a rocker arm according to claim 10, wherein:

the interval adjusting means is disposed in the wheel side unit, and this interval adjusting means is a sliding unit comprising a sliding base for supporting a main shaft unit including the grinding wheel, and a servo motor for sliding the sliding base in the direction of the rotary shaft of the grinding wheel.

12. A roundness processing device for a slipper surface of a rocker arm according to claim 10, wherein:

the delivering and discharging means is a delivering and discharging robot comprising a moving table movable in the direction of the rotary shaft of the grinding wheel, and a delivery loader and a discharge loader mounted on the moving table.

13. A roundness processing device for a slipper surface of a rocker arm according to claim 10, wherein:

the automatic control means comprises a numerical controller.

14. A roundness processing device for a slipper surface of a rocker arm according to claim 10, wherein:

the polishing surface is a circular polishing surface formed on an entire surface at one side of the grinding wheel, and the oscillation shaft is movable in the radial direction of the polishing surface orthogonal to the contact line between the polishing surface and slipper surface.

15. A roundness processing device for a slipper surface of a rocker arm according to claim 10, wherein:

the holding means of the rocker arm comprises a shaft member, pressing lever and positioning member which are mounted on the top of the jig, the shaft member is fitted into a shaft hole provided in a middle position of the rocker arm in a longitudinal direction so as to rotatably pivot the rocker arm, the pressing lever is stopped at one end of a back side of the rocker arm so as to elastically thrust this end portion to the grinding wheel side, and the positioning member comprises an adjusting screw engaged therewith, and the front end of this adjusting screw is stopped at an opposite side portion of the back side of the rocker arm.

16. A roundness processing device for a slipper surface of a rocker arm, the device comprising:

a wheel side unit containing a disc-shaped grinding wheel which is rotated and driven, p1 a jig side unit comprising an oscillatable jig for holding the rocker arm, means for conveying rocker arms, means for delivering and discharging the rocker arm conveyed by the conveying means into and out of the jig in the jig side unit, and means for automatically driving and controlling the wheel side unit, jig side unit, and delivering and discharging means in mutual relationship, wherein the grinding wheel comprises a polishing surface, which is a plane perpendicular to an axial line of the grinding wheel rotary shaft, at one side, the jig in the jig side unit comprises rocker arm holding means for holding the slipper surface of the rocker arm opposite the polishing surface, the jig comprises an oscillation shaft parallel to the polishing surface, the oscillation shaft being arranged within a plane perpendicular to the polishing surface containing a contact line between the polishing surface and slipper surface, the oscillation shaft is coupled with means for oscillating the jig within a preset angular range, either one of the wheel side unit and the jig side unit contains interval adjusting means for variably adjusting the interval between the polishing surface of the grinding wheel and the oscillation shaft line of the jig, the device is capable of processing the slipper surface of the rocker arm to a high degree of dimensional precision, the holding means of the rocker arm comprises a shaft member, pressing lever and positioning member which are mounted on the top of the jig, the shaft member is fitted into a shaft hole provided in a middle position of the rocker arm in a longitudinal direction so as to rotatably pivot the rocker arm, the pressing lever is stopped at one end of a back side of the rocker arm so as to elastically thrust this end portion to the grinding wheel side, and the positioning member comprises an adjusting screw engaged therewith, and the front end of this adjusting screw is stopped at an opposite side portion of the back side of the rocker arm.

17. A roundness processing device for a slipper surface of a rocker arm according to claim 16, wherein:

the interval adjusting means is disposed in the wheel side unit, and this interval adjusting means is a sliding unit comprising a sliding base for supporting a main shaft unit including the grinding wheel, and a servo motor for sliding the sliding base in the direction of the rotary shaft of the grinding wheel.

18. A roundness processing device for a slipper surface of a rocker arm according to claim 16, wherein:

the delivering and discharging means is a delivering and discharging robot comprising a moving table movable in the direction of the rotary shaft of the grinding wheel, and a delivery loader and a discharge loader mounted on the moving table.

19. A roundness processing device for a slipper surface of a rocker arm according to claim 16, wherein:

the automatic control means comprises a numerical controller.

20. A roundness processing device for a slipper surface of a rocker arm according to claim 16, wherein:

the polishing surface is a circular polishing surface formed on an entire surface at one side of the grinding wheel, and the oscillation shaft is movable in the radial direction of the polishing surface orthogonal to the contact line between the polishing surface and slipper surface.

21. A roundness processing device for a slipper surface of a rocker arm according to claim 16, wherein:

the polishing surface is an annular polishing surface formed on an entire periphery of the outer circumference at one side of the grinding wheel, in a specific polishing surface width.

22. A roundness processing device for a slipper surface of a rocker arm according to claim 21, wherein:

the polishing surface width h of the annular polishing surface is expressed as follows, supposing the outside diameter of the annular polishing surface to be 2r, and a center angle of the grinding wheel including two points intersecting contour lines at both ends in a widthwise direction of the slipper surface by an outside diameter line of the annular polishing surface to be $\theta$:

$$h = 2r \sin^2 \theta/4.$$

* * * * *